US006554160B2

(12) United States Patent
Beranger et al.

(10) Patent No.: US 6,554,160 B2
(45) Date of Patent: Apr. 29, 2003

(54) DISPENSER MEMBER SUCH AS A PUMP OR A VALVE

(75) Inventors: Stéphane Beranger, Le Neubourg (FR); Firmin Garcia, Evreux (FR)

(73) Assignee: Valois S.A., Le Neubourg (FR)

( * ) Notice: Subject to any disclaimer, the term of this patent is extended or adjusted under 35 U.S.C. 154(b) by 0 days.

(21) Appl. No.: 10/101,181

(22) Filed: Mar. 20, 2002

(65) Prior Publication Data

US 2002/0185503 A1 Dec. 12, 2002

Related U.S. Application Data

(60) Provisional application No. 60/291,006, filed on May 16, 2001.

(30) Foreign Application Priority Data

Mar. 22, 2001 (FR) ..... 01 03891

(51) Int. Cl.[7] ..... B67D 5/40
(52) U.S. Cl. ..... 222/1; 222/321.9; 222/385
(58) Field of Search ..... 222/372, 383.1, 222/385, 320, 321.1, 321.7, 321.9

(56) References Cited

U.S. PATENT DOCUMENTS 3,937,366 A * 2/1976 Steiman ..... 222/321.9
5,482,188 A * 1/1996 Lina ..... 222/321.2
6,073,805 A * 6/2000 Gueret ..... 222/95
6,186,370 B1 * 2/2001 de Pous et al. ..... 222/321.9
6,371,337 B2 * 4/2002 Garcia et al. ..... 222/385
6,422,429 B2 * 7/2002 Garcia et al. ..... 222/385
6,446,841 B1 * 9/2002 Petit ..... 222/321.9
6,488,185 B2 * 12/2002 Beranger et al. ..... 222/385

FOREIGN PATENT DOCUMENTS

FR 2 320 789 3/1977
FR 2 792 295 10/2000

* cited by examiner

*Primary Examiner*—Stephanie L. Willatt
(74) *Attorney, Agent, or Firm*—Sughrue Mion, PLLC

(57) ABSTRACT

A dispenser member such as a pump or a valve, comprising:

a body (2) in which a piston (3) is slidably received and in which a ferrule (4) is engaged; and fixing means (5) comprising at least one peripheral projection (53) that projects radially outwards, said projection (53) serving to come into engagement in a notch (82) formed in an inside wall (81) of the neck (80) of a receptacle (8), said projection (53) being elastically displaceable radially inwards so as to come into engagement in the notch (82) in the neck by elastically deforming the body (2) radially inwards in a deformation zone (200);

said dispenser member being characterized in that the ferrule (4) is not in contact with the body at the deformation zone (200) of the body (2).

13 Claims, 1 Drawing Sheet

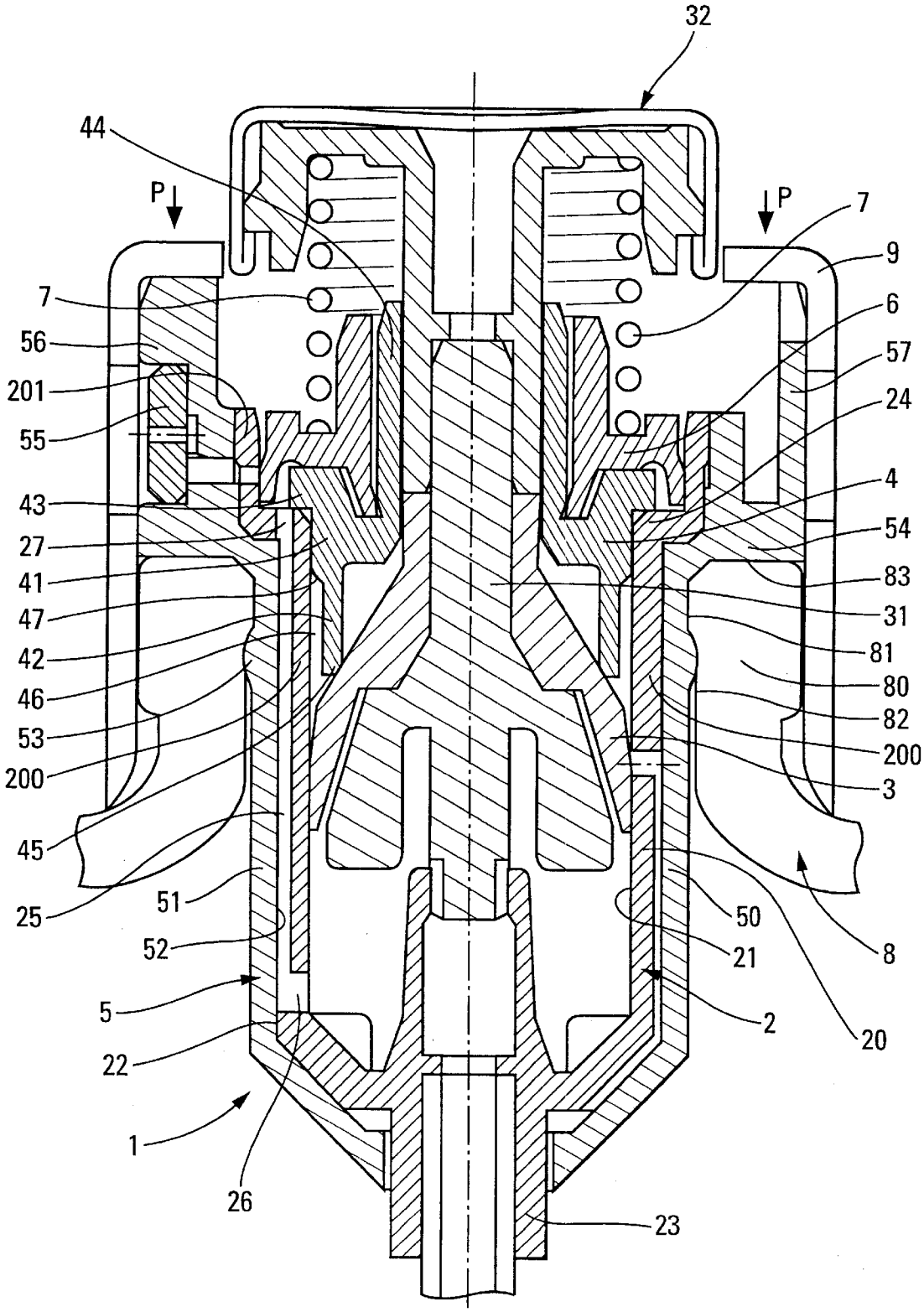
Figure Unique

DISPENSER MEMBER SUCH AS A PUMP OR A VALVE

CROSS REFERENCE TO RELATED APPLICATION

This application claims the benefit under 35 U.S.C. §119 (e) of U.S. provisional patent application Ser. No. 60/291,006, filed May 16, 2001, and priority under 35 U.S.C. §119(*a*)–(*d*) of French patent application No. FR-01.03891, filed Mar. 22, 2001.

TECHNICAL FIELD

The present invention relates to a dispenser member such as a pump or a valve, and to a method of installing such a dispenser member.

BACKROUND OF THE INVENTION

More particularly, such a dispenser member comprises a body in which a piston is mounted to slide so as to cause the volume of a pump or valve chamber to vary. In general, in order to move the piston, a pusher is provided that is connected to the piston via an actuator rod. Furthermore, it is known that a ferrule can be used that is engaged (preferably by force) in the body. The ferrule serves as a leaktight stopper at the top end of the body, and it defines a high abutment for the piston in the rest position in which the chamber reaches its maximum volume. The piston is urged against the ferrule by a return spring. That design is quite conventional for a pump or a valve.

A conventional dispenser member further comprises fixing means for fixing it onto or into the neck. In the present case, the fixing means comprise at least one peripheral projection that projects radially outwards. The projection serves to come into engagement in a notch formed in the inside wall of a receptacle neck. That is a technique for snap-fastening inside the neck of a receptacle. The projection(s) may be formed on the outside wall of the body or on the outside wall of a skirt that surrounds the body in tightly-fitting and preferably leaktight manner.

In order to reach a final snap-fastening position in the notch in the neck, the projection(s) must be capable of being elastically displaced radially inwards to pass through the smaller-diameter inlet section of the neck that is situated immediately above the notch.

Such a dispenser member is described in Document FR 2 792 295.

A requirement also exists that is related to the design of modern pumps or valves. It is preferable for the pump or valve to have as small a height as possible above the neck of the receptacle, which requires the body of the dispenser member to be engaged as far as possible into the neck of the receptacle. It is thus advantageous to engage the body in the neck so that its top end is situated approximately level with the top end of the neck. In which case, the ferrule engaged by force in the body is also engaged inside the neck and can extend to the level of the projection(s) formed by the fixing means. Since the ferrule is a part that is relatively rigid because it must be capable of withstanding the stress from the piston in the rest position, it is almost non-deformable, and it can therefore hinder the operation of fixing the pump inside the neck. In the above-mentioned document, provision is made for the ferrule to be put in place finally only once the projections are engaged in the notch in the neck.

BRIEF SUMMARY OF THE INVENTION

An object of the present invention is to remedy the above-mentioned drawbacks of the prior art by defining a dispenser member having a ferrule which, while performing its usual function of leaktight stopper and of high abutment for the piston, also makes it easy for the dispenser member to be fixed in the neck of a receptacle provided with a snap-fastening notch.

The above-mentioned problems are solved by a dispenser member such as a pump or a valve, comprising: a body in which a piston is slidably received and in which a ferrule is engaged; and fixing means comprising at least one peripheral projection that projects radially outwards, said projection serving to come into engagement in a notch formed in an inside wall of the neck of a receptacle, said projection being elastically displaceable radially inwards so as to come into engagement in the notch in the neck by elastically deforming the body radially inwards in a deformation zone, the ferrule not being in contact with the body in said deformation zone. This means that the ferrule does not extend to the level of the deformation zone or that the ferrule is not in contact with the body at said deformation zone.

Preferably, the ferrule extends axially in the body to the level of projection, an intermediate space then being provided between the body and the ferrule to enable the body to deform radially inwards. This is particularly advantageous because it is thus possible to satisfy the above-mentioned requirement related to keeping the height of the pump above the neck as small as possible.

Thus, the projections and the body are free to deform elastically inwards into the intermediate space without being hindered by the rigid ferrule. The ferrule nevertheless retains all of its initial functions, namely those of stopper and of rest high abutment for the piston.

Advantageously, said intermediate space is formed by an inwardly-extending shoulder on the ferrule. In a variant, or in addition, said intermediate space is formed by a reduction in the thickness of the wall of the ferrule.

In a practical embodiment, the ferrule comprises a first section in tightly-fitting contact in the body and a second section spaced apart from the body at least in part to form the intermediate space. The first section is situated immediately at the inlet of the body above the projection, while the smaller second section is situated at the level of the projections.

According to another characteristic, the ferrule is provided with an abutment flange in abutment against an end of the body.

According to another feature of the invention, the fixing means are provided with a skirt which extends around the body, the projection being formed on an outside wall of the skirt, a delivery channel being formed between the skirt and the body to enable the fluid to be delivered from the body under the action of the piston. Advantageously, the body is engaged in the skirt with tight-fitting and leaktight contact so that they isolate the delivery channel between them.

In a variant, the projection is formed by an outside wall of the body.

The present invention also provides a method of fixing a dispenser member such as a pump or a valve, said dispenser member comprising: a body in which a piston is slidably received and in which a ferrule is engaged; and fixing means in which the body is received, said fixing means comprising at least one peripheral projection that projects radially outwards, said projection serving to come into engagement in a notch formed in an inside wall of the neck of a receptacle, said projection being elastically displaceable radially inwards so as to come into engagement in the notch in the neck by elastically deforming the body radially inwards; said method comprising the step of exerting sufficient pressure on the fixing means to bring the projections into the notch in the neck.

Advantageously, the ferrule is not in contact with the deformation zone of the body. Preferably, the ferrule extends axially in the body to the level of the projection, an intermediate space being provided between the body and the ferrule to enable the body to deform radially inwards.

BRIEF DESCRIPTION OF THE DRAWINGS

The invention is described more fully below with reference to the sole drawing which is a view in vertical section through a dispenser member of the invention as fitted on the neck of a receptacle.

DETAILED DESCRIPTION

The dispenser member shown in the sole figure is a pump, but it may also be a valve. The pump is given overall reference 1, and it comprises a pump body 2 defining a cylindrical barrel 20 inside which a piston 3 is slidably received that is mounted on an actuator rod 31 capped with a pusher 32. At its bottom end, the body 2 defines an inlet in the form of a sleeve 23 advantageously serving to receive a dip tube which extends inside the reservoir down to its bottom. At the opposite end, the body 2 defines a top end 24 in the form of an outwardly-extending shoulder. The piston 3 is urged by a return spring 7 into a rest position shown in the sole figure. This rest position is set by a ferrule 4 engaged by force into the body 2. More precisely, the ferrule 4 comes into abutment against the top end 24 of the body 20 via an abutment flange 43, and it extends downwards therefrom inside the body 2 to define an abutment 45 for the piston 3 at its bottom end. This is a quite conventional design for a pump or a valve in the fields of cosmetics, of perfumes, or of pharmaceuticals.

In addition, the pump 1 is provided with fixing means. In this example, they are constituted by a ring 5 defining a substantially cylindrical skirt 50 in which the pump body 2 is engaged. The pump body is engaged in the skirt 50 in tightly-fitting and leaktight manner. The outside wall 22 of the barrel 20 is in tightly-fitting and leaktight contact with the inside wall 52 of the skirt 50. The skirt 50 has an outside wall 51 that is provided with one or more projections 53 that may be in the form of lugs distributed around the periphery of the skirt or else in the form of a continuous peripheral bead. All these variants are designated by the term "projection" 53. As can be seen in the sole figure, the projection 53 is engaged inside a notch 82 formed in the inside wall 81 of a neck 80. The final snap-fastening position is reached when the projection 53 is received in the notch 82 and when the ring 5 comes into contact via an abutment collar 54 against the top end 83 of the receptacle neck. However, it should be noted that, above the notch 82, the inside wall 81 of the neck 80 forms a section of smaller diameter. In order to reach its snap-fastening position, the projection 53 must pass through this smaller-diameter section and is subjected to elastic deformation radially inwards as it passes through said section. In general, the receptacle may be made of glass or of a non-deformable plastic, while the ring 5 and the body 2 may be made of a more-deformable plastic. However, since the skirt 50 is in contact with the barrel 20 of the body 2, the inward elastic deformation of the projection 53 causes the barrel 50 of the body 2 to be deformed at said projection. The inside wall 21 of the barrel 20 of the body 2 is thus momentarily and locally subjected to inward elastic deformation until the projection 53 is received in the notch 82 in the neck 80. This deformation takes place in a zone 200 of the body that is situated facing the projections 53.

Furthermore, it can be noted that the ferrule 4 is engaged in the pump 2 to the level of the projection 53. This is because it is currently preferably or even essential to reduce the height of the pump above the neck, and thus to cause the pump body 2 to penetrate as far as possible into the neck. It is easy to see that the abutment flange 43 of the ferrule 4 is situated only very slightly above the top end 83 of the neck 80. Therefore, the ferrule extends inside the body down to the level of the projection 53. However, it is possible to consider other embodiments in which the ferrule does not extend to the level of the zone 200 in which the body 2 is deformed. But the embodiment shown in the sole figure is preferred as regards the position of the ferrule relative to the projections.

In the invention, in order to enable the inside wall 21 of the pump body 2 to be elastically deformed radially inwards under the effect of the deformation of the projection 53, an intermediate space 46 is provided between the inside wall 21 of the pump body 2 and the ferrule 4. This intermediate space 46 may be in the form of a cylindrical annular gap, or else in the form of a plurality of longitudinal notches that extend over the height of the ferrule. For example, it is possible for the ring 5 to form six projections 56. Six corresponding intermediate spaces can then be provided situated facing respective ones of the projections. However, in a practical embodiment, it is easier to provide the intermediate space in the form of a complete annular gap which extends between the ferrule and the inside wall 21 of the pump body 2. By providing this intermediate space 46, it is possible to engage the projection 53 into the notch 82 by inward radial deformation without spoiling or altering the function of the ferrule 4 whose bottom end 45 still serves as a high abutment for the piston 3.

More precisely, below its abutment flange 43, the ferrule 4 has an upper first section 41 engaged in tightly-fitting contact inside the pump body 2 at the top end 24 thereof, and a bottom second section 47 which is spaced apart at least in part from the inside wall 21 of the body and whose bottom end forms the high abutment 45 for the piston 3. The intermediate space 46 may be formed by an inwardly-extending shoulder of the ferrule and/or by a reduction in the thickness of the wall of the ferrule. In the example shown in the sole figure, it is formed by an inwardly-extending shoulder that generates a reduction in the thickness of the wall of the ferrule at its bottom second section 47. The upper first section 41 performs on its own the function of securely anchoring the ferrule 4 inside the pump body 2, while the bottom second section 47 provides the high abutment 45 and makes it possible to form the intermediate space 46.

As explained above, the outside wall 22 of the barrel 20 of the pump body 2 is engaged in tightly-fitting and leaktight manner inside the skirt 50, i.e. against the inside wall 52 thereof. According to another characteristic of the invention, a delivery channel 25 is formed between the barrel 20 and the skirt 50 and it extends over almost the entire height of the barrel 20, and therefore also at the projection 53 and at the space 46. The delivery channel 25 communicates with the pump chamber via an inlet 26 and opens out at its top end 27 in an outlet valve other chamber whose volume can be caused to vary by displacing a moving valve member 6 mounted to slide both in an extension 201 of the pump body 20 and on a guide bushing 44 formed by the ferrule 4. The moving valve member 6 is urged into its rest position by the return spring 7 which bears against the underside of the pusher 32. Beyond the outlet valve, the fluid reaches a nozzle 55 which enables the fluid to be sprayed. The nozzle 55 is received in a recess 56 formed by the ring 5. It can be said that, above the abutment collar 54, the ring 5 forms a bushing 57 in which the recess 56 is provided for receiving the nozzle 55. The bushing 57 may be covered or capped with a trim band 9 that is preferably made of metal.

For the purpose of fixing the pump in the neck 80 of the receptacle, i.e. for engaging the projections 53 in the notch 82, sufficient pressure P can be applied on the ring 5 or more precisely on the bushing 57 or on the band 9 if such a band exists.

It is possible to use this method of fixing by pressing on the fixing ring 5 even if the ferrule 4 does not extend to the level of the projections 53. Naturally, it must be possible for the projections 53 to be displaced inwards without being hindered by the ferrule, which is possible when an intermediate space is provided between the pump body 2 and the ferrule 4.

This is merely a particular embodiment that in no way limits the present invention whose spirit lies in the fact that the ferrule cannot prevent the body from deforming inwards on fitting the pump in the receptacle neck. A preferred embodiment is constituted by an intermediate space being provided between the ferrule and the pump body to enable the pump body to deform radially inwards under the effect of the deformation of the projection so as to engage in the notch formed by the neck of the receptacle.

What is claimed is:

1. A dispenser member such as a pump or a valve, comprising:

a body (2) in which a piston (3) is slidably received and in which a ferrule (4) is engaged; and fixing means (5) comprising at least one peripheral projection (53) that projects radially outwards, said projection (53) serving to come into engagement in a notch (82) formed in an inside wall (81) of the neck (80) of a receptacle (8), said projection (53) being elastically displaceable radially inwards so as to come into engagement in the notch (82) in the neck by elastically deforming the body (2) radially inwards in a deformation zone (200);

said dispenser member being characterized in that the ferrule (4) is not in contact with the body at the deformation zone (200) of the body (2).

2. A dispenser member according to claim 1, in which the ferrule (4) extends axially in the body (2) to the level of the deformation zone (200), an intermediate space (46) being provided between the body (2) and the ferrule (4) at the deformation zone (200) to enable the body to deform radially inwards.

3. A dispenser member according to claim 2, in which said intermediate space (46) is formed by an inwardly-extending shoulder (47) on the ferrule (4).

4. A dispenser member according to claim 1, in which said intermediate space (46) is formed by a reduction in the thickness of the wall of the ferrule.

5. A dispenser member according to claim 1, in which the ferrule (4) forms a rest high abutment (45) for the piston (3).

6. A dispenser member according to claim 1, in which the ferrule (4) comprises a first section (41) in tightly-fitting contact in the body (2) and a second section (42) spaced apart from the body at least in part to form the intermediate space (46).

7. A dispenser member according to claim 1, in which the ferrule (4) is provided with an abutment flange (43) in abutment against an end (24) of the body (2).

8. A dispenser member according to claim 1, in which the fixing means (5) are provided with a skirt (50) which extends around the body (2), the projection (53) being formed on an outside wall (51) of the skirt (50), a delivery channel (25) being formed between the skirt (50) and the body (2) to enable the fluid to be delivered from the body (2) under the action of the piston (3).

9. A dispenser member according to claim 7, in which the body (2) is engaged in the skirt (50) with tight-fitting and leaktight contact so that they isolate the delivery channel (25) between them.

10. A dispenser member according to claim 1, in which the projection (3) is formed by an outside wall of the body (2).

11. A method of fixing a dispenser member such as a pump or a valve, said dispenser member comprising:

a body (2) in which a piston (3) is slidably received and in which a ferrule (4) is engaged; and fixing means (5) in which the body (2) is received, said fixing means comprising at least one peripheral projection (53) that projects radially outwards, said projection (53) serving to come into engagement in a notch (82) formed in an inside wall (81) of the neck (80) of a receptacle (8), said projection (53) being elastically displaceable radially inwards so as to come into engagement in the notch (82) in the neck by elastically deforming the body (2) radially inwards; said method comprising the step of exerting sufficient pressure on the fixing means (5) to bring the projections (53) into the notch (83) in the neck.

12. A method according to claim 11, in which the ferrule (4) is not in contact with the deformation zone (220) of the body (2).

13. A method according to claim 11, in which the ferrule (4) extends axially in the body (2) to the level of the projection (53), an intermediate space (46) being provided between the body (2) and the ferrule (4) to enable the body to deform radially inwards.

* * * * *